US007004088B2

(12) United States Patent
Ford

(10) Patent No.: US 7,004,088 B2
(45) Date of Patent: Feb. 28, 2006

(54) PROTECTIVE DEVICE FOR INCINERATION APPARATUS

(75) Inventor: Gary D. Ford, Palm City, FL (US)

(73) Assignee: Air Burners, LLC, Palm City, FL (US)

( * ) Notice: Subject to any disclaimer, the term of this patent is extended or adjusted under 35 U.S.C. 154(b) by 0 days.

(21) Appl. No.: 10/858,314

(22) Filed: Jun. 1, 2004

(65) Prior Publication Data

US 2005/0011424 A1 Jan. 20, 2005

Related U.S. Application Data

(60) Provisional application No. 60/475,209, filed on May 30, 2003.

(51) Int. Cl.
*F23J 3/04* (2006.01)

(52) U.S. Cl. ..... 110/241; 110/217

(58) Field of Classification Search ..... 110/346, 110/193, 197, 217, 239, 240, 241, 119; 126/280
See application file for complete search history.

(56) References Cited

U.S. PATENT DOCUMENTS 3,785,302 A * 1/1974 Davis ..... 110/215
3,785,303 A * 1/1974 Hopkins ..... 110/215
4,756,258 A 7/1988 Gilbert
5,415,113 A 5/1995 Wheeler et al.

* cited by examiner

*Primary Examiner*—Kenneth Rinehart
(74) *Attorney, Agent, or Firm*—Hodgson Russ LLP

(57) ABSTRACT

A protective device may be attached to a portable incineration apparatus, or used over an open pit. The protection device may be a screen constructed of a stainless steel mesh. The screen is laid across the open top of the portable incineration apparatus or the top of the open pit. The screen forms a seal between the top portion of the walls of the incineration apparatus, or of the pit, and the portion of the screen that engages the top portion of the walls. Thereby, smoke, ashes and-embers are limited, or even prevented from escaping from the incineration apparatus or the open pit.

5 Claims, 4 Drawing Sheets

PROTECTIVE DEVICE FOR INCINERATION APPARATUS

PRIORITY CLAIM

This application claims priority to U.S. Provisional Patent Application Ser. No. 60/475,209, filed May 30, 2003.

FIELD OF INVENTION

The present invention relates to the disposal of waste and more particularly to a protective device for use with an incineration apparatus. The incineration apparatus may be of the portable type or the type that is used to burn materials in a trench or open pit.

BACKGROUND OF THE INVENTION

The disposal of waste such as trees, brush, yard waste, etc. is a major concern of the municipal, commercial and private sectors. Various types of recycling equipment and techniques are in use or have been proposed to dispose of such waste, all with varying degrees of success.

One method is to transport and to bury the waste in a landfill. However, landfill sites are becoming scarce and those remaining are cost prohibitive especially in rapidly growing urban areas. In addition, even if suitable sites can be found, they are often at a distance that makes transportation costs prohibitive. Since vegetation waste makes up approximately 40% of the bulk typically buried in landfills, most large cities require that the waste be separated from conventional garbage for purposes of mulch and compost manufacture in an effort to recycle the waste.

Each year there are tens of thousands of acres of land cleared of trees, brush, etc. for development and millions of tons of yard waste (small branches, leaves, grass, etc.) produced. Reducing the amount of such waste being buried or mulched would significantly reduce the pressure on the existing landfills and delay the need for opening new landfill sites. In addition, landfills are a relatively inefficient method of recycling. Being simply buried at one site, the economic potential of the waste material is never fulfilled. Also, solid waste landfills are diminishing rapidly and permits for new sites are difficult to secure.

Another waste material that presents challenges with regard to disposal is animal carcasses. In the past, diseased animal carcasses were usually buried and forgotten. Little was known about the agents that caused the deadly diseases which have wiped out many herds of cattle and entire chicken farms. It has been discovered that certain pathogens can survive for over fifty years in the soil where they have been buried along with animal carcasses that perished from the disease.

One alternative to landfills has been to incinerate the waste material. With regard to wood and vegetation wastes, this produces an ash residue which is extremely high in natural nutrients beneficial for plant growth. When the ash is mixed with compost and varying amounts of soil, a range of products from high-grade potting soil to top soil are developed. Open burning of the vegetation waste on site is the simplest and most cost effective way of incinerating the waste material. However, due to the many environmental limitations imposed by federal, state, and local jurisdictions, open burning is not always feasible or possible. With regard to the disposal of animal carcasses, the only known practical approach to the elimination of diseased carcasses is high temperature incineration.

Some open pit incineration has been made possible through the use of air curtain incinerators such as the device disclosed in U.S. Pat. No. 4,756,258. In an open pit incinerator, the waste is loaded into a fire pit through an opening and then ignited. High velocity air from a manifold positioned along the opening is then blown over and into the pit. The air flow pattern is intended to over-oxygenate the fire for more complete combustion and to provide a rotating mass of air that acts as a barrier or curtain to reduce the emission of smoke and ash from the fire.

In response to some of the drawbacks associated with open pit burning, a portable incineration apparatus was developed. U.S. Pat. No. 5,415,113, which is assigned to the assignee of the present invention, discloses a portable incineration apparatus that provides an air curtain for reducing the emission of smoke and ash and to provide for more complete combustion of the waste materials. The apparatus provides a box having four walls with a top opening and a bottom opening. The inside of the walls are lined with a layer of a refractory material to form a combustion chamber. The incinerator also includes a source of high velocity air that is in air transfer communication with a manifold assembly. The manifold assembly is adapted to direct an effective sheet or curtain of high velocity air across the top of the opening and down into the combustion chamber and to maintain a substantially uniform discharge rate of the high velocity air as it exits the manifold assembly along the top opening. The high velocity air curtain covers the top opening and creates a rotational turbulence within the combustion chamber. It has been found that because of the substantially uniform discharge rate, the resulting curtain of high velocity air over the top opening limits the amount of particulate, such as ash, released into the atmosphere during combustion and virtually eliminates opacity or smoke.

For both the box and the open pit type of incineration, the burning embers that remain while the incinerator is unattended are a concern. The box or trench is typically unattended at the end of shifts, overnight, on weekends or the like. When the incineration apparatus is shut down, there is normally fire in the box or the trench, and therefore, there is a risk that embers will escape if the wind picks up or if a log should collapse in the fire. If the embers escape, there is a risk of starting a fire outside of the box or trench.

Accordingly, there is a need for a protective device for use with an incineration apparatus.

SUMMARY OF THE INVENTION

The present invention meets the above-described need by providing a protective device for use in connection with an incineration apparatus of the portable type or for use in open pit burning.

A protective device may be attached to a portable incineration apparatus, or used over an open pit. The protection device may be a screen constructed of a stainless steel mesh. The screen is laid across the open top of the portable incineration apparatus or the top of the open pit. The screen forms a seal between the top portion of the walls of the incineration apparatus, or of the pit, and the portion of the screen that engages the top portion of the walls. Thereby, smoke, ashes and embers are limited, or even prevented from escaping from the incineration apparatus or the open pit.

BRIEF DESCRIPTION OF THE DRAWINGS

The invention is illustrated in the drawings in which like reference characters designate the same or similar parts throughout the figures of which.

DETAILED DESCRIPTION

Figure 1:
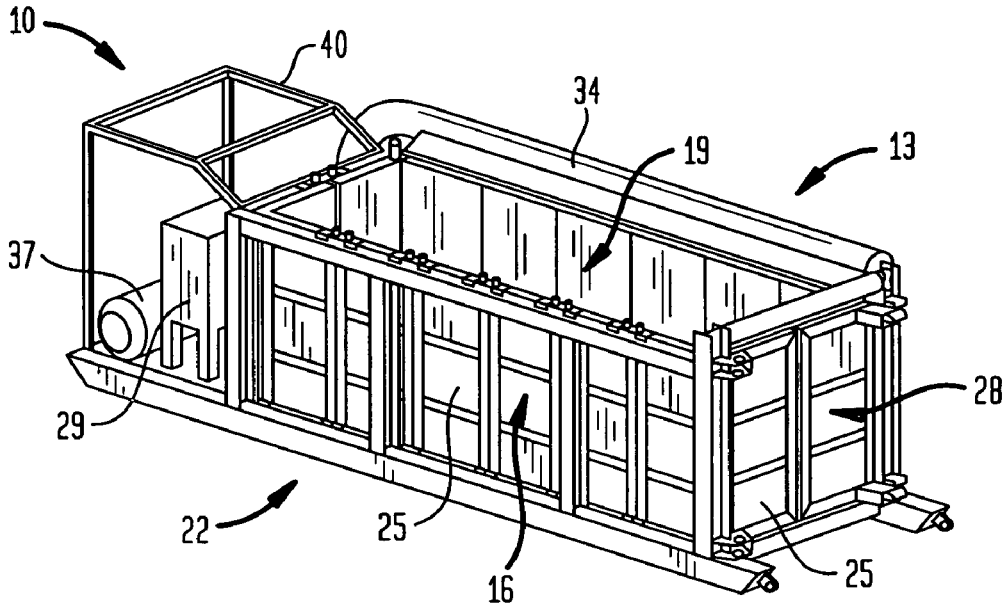
FIG. 1 (PRIOR ART)
FIG. 1 is a perspective view of a portable incineration apparatus.
Figure 2:
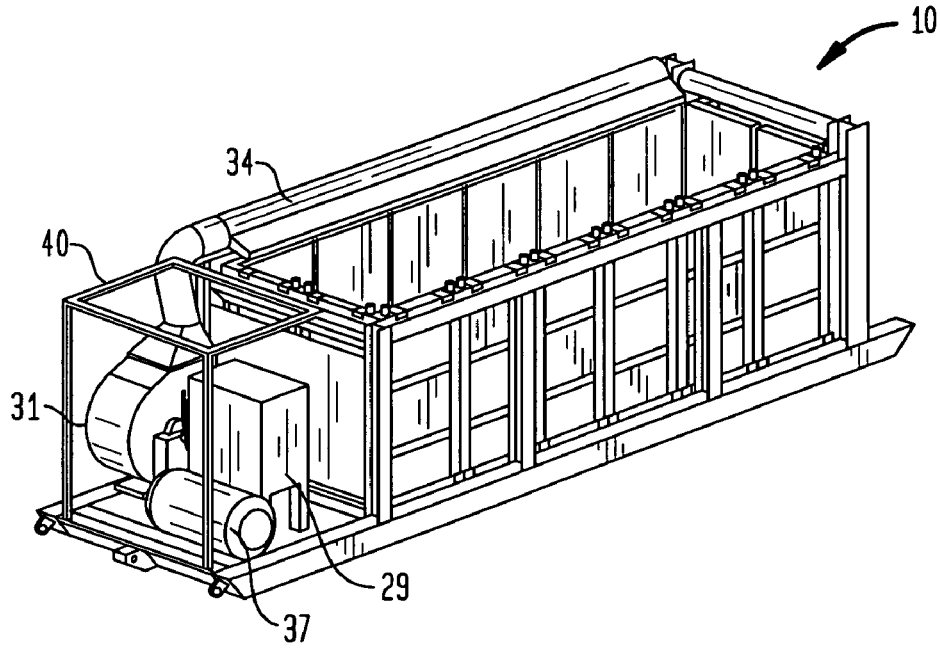
FIG. 2 (PRIOR ART)
FIG. 2 is a different perspective view of the portable incineration apparatus shown in FIG. 1.

Referring to FIGS. 1–2, a portable incineration apparatus 10 suitable for use in the present invention is shown. The portable incineration apparatus is described in detail in U.S. Pat. No. 5,415,113 to Wheeler et al., which is assigned to the assignee of the present invention and which is incorporated herein by reference. The apparatus 10 provides a box 13 having four walls 16 with a top opening 19 and a bottom opening 22.

Each wall 16 is lined on the inside with a layer of refractory material in the form of refractory panels 25. The inside of the doors 28 at the end of the unit are similarly lined with a refractory panel 25. Each panel 25 is preferably constructed with ⅜"×4"×4" steel angle having ⅜"×2" flat bar back supports and ¼" thick 304 stainless steel holding clips all continuously welded into a suitably sized sub-frame. Each sub-frame is poured solid 4" thick with a 2800° F. rated refractory material that is castable and strengthened with stainless steel needles. Satisfactory results have been obtained using a refractory material named Kaocrete 28-LI "RFT" filled with stainless steel needles.

An internal combustion engine 29 which may use gasoline or diesel fuel is mounted on the apparatus 10 and provides a preferred power source for the portable apparatus. The engine 29 drives a shaft (not shown) of a fan 31 through a suitable speed reducer as known to those of ordinary skill in the art. The fan 31 conveys air at high velocities through a manifold 34 disposed adjacent to the top of the apparatus 10. A fuel tank 37 containing a supply of fuel for the engine 29 is also mounted to the apparatus 10. A cover 40 protects the engine 29 and fan 31 from exposure to the elements.

Figure 3:
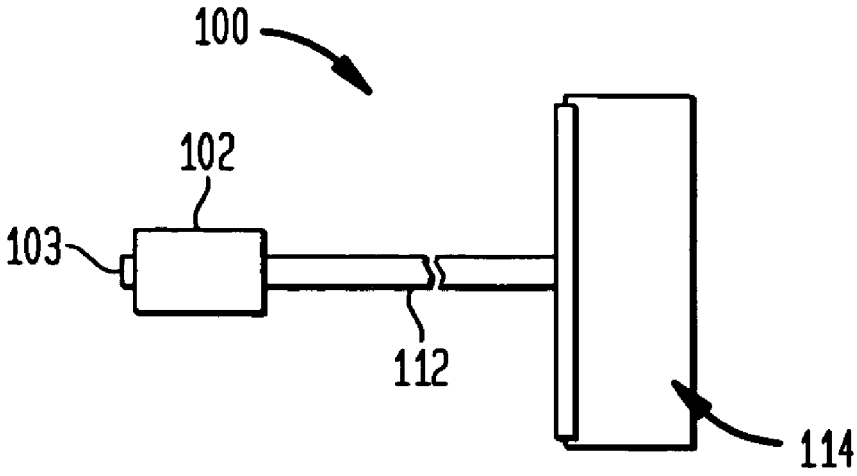
FIG. 3 (PRIOR ART)
FIG. 3 is a top plan view of an incineration apparatus for use with an open pit.
Figure 4:
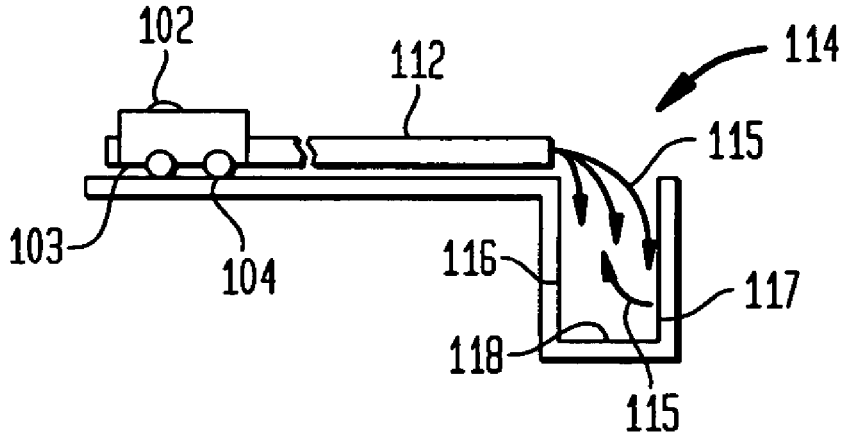
FIG. 4 (PRIOR ART)
FIG. 4 is a side elevation view of the apparatus of FIG. 3.

Turning to FIGS. 3 and 4, an incineration apparatus 100 includes a fan 102 mounted on a trailer 103 having a set of wheels 104. As will be evident to those of ordinary skill in the art an internal combustion engine mounted on the trailer 103 may use gasoline or diesel fuel and provides a preferred power source for the portable apparatus. The engine drives a shaft (not shown) of the fan 102 through a suitable speed reducer. The fan 102 conveys air at high velocities through a manifold 112. The manifold 112 may be constructed in a T-shape (best shown in FIG. 3). The manifold 112 conveys the high velocity air from the fan 102 to one of the edges of an open pit 114. The path of the high velocity air is indicated by arrows 115. As best shown in FIG. 4, the pit 114 has side walls 116, 117 and bottom wall 118. As will be evident to those of ordinary skill in the art, the pit 114 is typically constructed with earth moving equipment and is typically ten to twelve feet deep.

Figure 5:
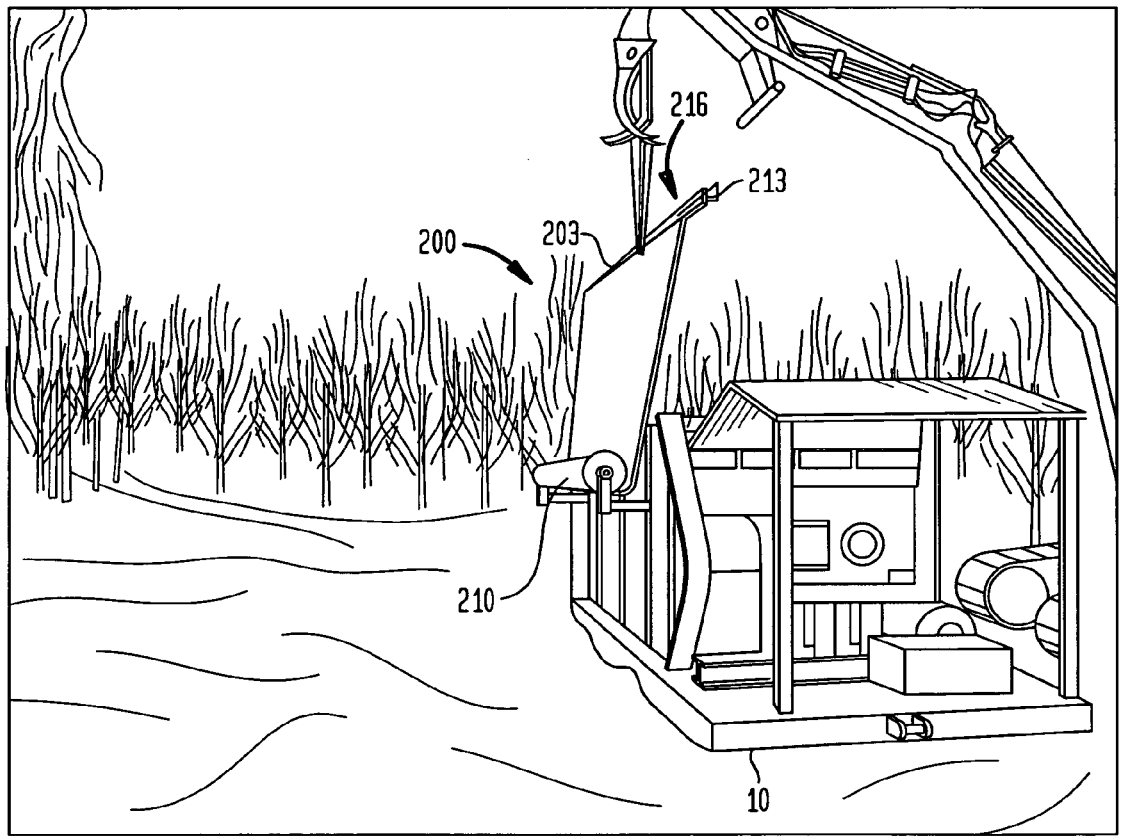
FIG. 5 is a perspective view of a portable incineration apparatus equipped with the protective device of the present invention; and, FIG. 6 is another perspective view of the portable incineration apparatus shown in FIG. 5.

Turning to FIG. 5, the protective device 200 of the present invention is mounted to the side of a portable incineration apparatus 10. The protective device 200 comprises a screen 203 that may be constructed out of a stainless steel mesh having a part number B485116. The screen 203 may be woven or formed by other means. The screen 203 may have a balanced weave with strands having a diameter of one-sixteenth of an inch. The mesh screen 203 is constructed of a material that can withstand the heat from the fire without permanent deformation and also is corrosion resistant. The screen 203 is flexible such that it "hammocks" or curves downward inside the opening 19 (FIG. 1) under its weight such that a seal is formed between a portion of the screen 203 and the tops of the walls 16 (FIG. 1) that engage with the portion of the screen 203 and support the weight of the screen 203. Similarly, when the protective device 200 is used with an open pit incineration apparatus 100, the protective device 200 "hammocks" down into the pit 114 (FIG. 4) and forms a seal between the tops of the walls 116, 117 of the pit 114 and the portion of the screen 203 that engages with, and is supported by, the tops of the walls 116, 117 of the pit 114.

Figure 6:
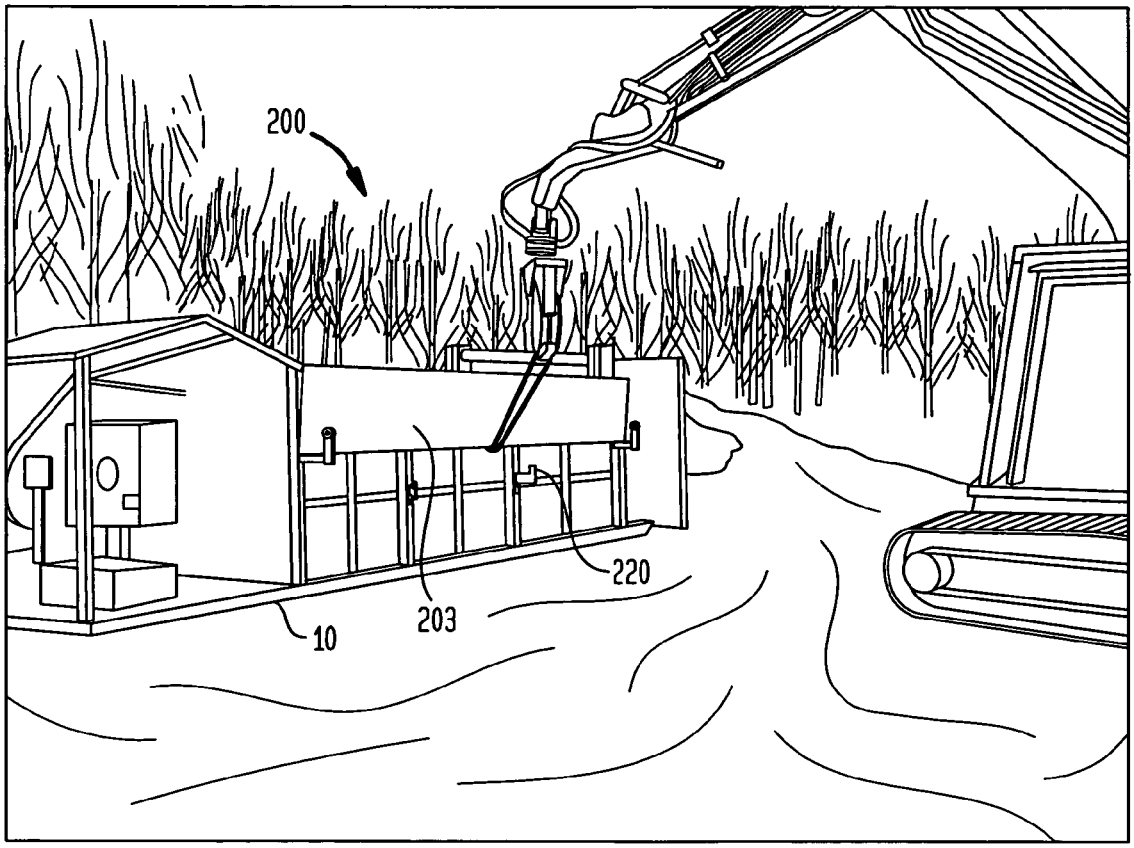

The screen 200 may be stored on a take-up wheel 210 as the material may be flexible enough to store in a roll. The protective device 200 may also be folded up when not in use. A counterweight 213 is attached to the protective device 200 at a distal end 216. The counterweight 213 is carried across the opening 19 (best shown in FIG. 1) and disposed on the opposite side of the wall 16 such that the protective device 200 is draped across the opening 19 of the portable incineration apparatus 10 when it is not in use. The counterweight 213 may be allowed to hang freely where it pulls the screen 203 taut between the portion that rests on the top of the wall 16 and the portion where the counterweight 213 is attached. As described previously, the protective device 200 is not pulled taut across the opening 19 to the incineration apparatus 10 but is allowed to curve downward into the opening 19. As shown in FIG. 6, the outside of the walls 16 may be provided with bracket 220 for supporting the counterweight 213.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A portable incineration apparatus comprising:

a transportable box defined by four walls with an open top and an open bottom, the four walls lined with a refractory material operatively associated with the open bottom to form a combustion chamber, one wall having two doors being openable outwardly;

a source of high velocity air;

a manifold assembly in air transfer communication with the source of high velocity air, wherein the manifold assembly directs a curtain of high velocity air across the top opening and down into the combustion chamber; and a retractable screen adapted to overlie the open top of the transportable box in a deployed position, wherein the screen is attached on one end to a take-up wheel connected to one of the walls of the box such that the screen is capable of being stored in a roll when not in use.

2. The portable incineration apparatus of claim 1, wherein a counterweight is attached to an end of the screen opposite the take-up wheel.

3. A portable incineration apparatus comprising:

a transportable box defined by four walls with an open top and an open bottom, the four walls lined with a refractory material operatively associated with the open bottom to form a combustion chamber, one wall having two doors being openable outwardly;

a source of high velocity air;

a manifold assembly in air transfer communication with the source of high velocity air, wherein the manifold assembly directs a curtain of high velocity air across the top opening and down into the combustion chamber; and a retractable screen adapted to overlie the open top of the transportable box in a deployed position, wherein the screen is constructed of a stainless steel mesh, and wherein the screen is laid across the open top of the box and the screen forms a seal between a top surface of the walls of the box and a portion of the screen that engages the top surface of the walls of the box.

4. The portable incineration apparatus of claim 3, further comprising a bracket for supporting the counterweight when the screen is in use.

5. A portable incineration apparatus comprising:

a transportable box defined by four walls with an open top and an open bottom, the four walls lined with a refractory material operatively associated with the open bottom to form a combustion chamber, one wall having two doors being openable outwardly;

a source of high velocity air:

a manifold assembly in air transfer communication with the source of high velocity air, wherein the manifold assembly directs a curtain of high velocity air across the top opening and down into the combustion chamber; and a retractable screen adapted to overlie the open top of the transportable box in a deployed position, wherein the screen is stored in a folded position when not in use.

* * * * *